US008231509B2

(12) United States Patent
Lundquist

(10) Patent No.: US 8,231,509 B2
(45) Date of Patent: Jul. 31, 2012

(54) WEIGHT LIFTING POWER MACHINE WITH SLAVE RACK

(75) Inventor: Randal L. Lundquist, Mansfield, OH (US)

(73) Assignee: Recreation Supply, Inc., Sunbury, OH (US)

( * ) Notice: Subject to any disclaimer, the term of this patent is extended or adjusted under 35 U.S.C. 154(b) by 0 days.

(21) Appl. No.: 12/949,048

(22) Filed: Nov. 18, 2010

(65) Prior Publication Data

US 2012/0129662 A1 May 24, 2012

(51) Int. Cl.
*A63B 21/06* (2006.01)

(52) U.S. Cl. ..... 482/98; 482/94

(58) Field of Classification Search ..... 482/92–105
See application file for complete search history.

(56) References Cited

U.S. PATENT DOCUMENTS

| | | | | |
|---|---|---|---|---|
| 4,795,149 | A * | 1/1989 | Pearson | 482/98 |
| 5,050,868 | A * | 9/1991 | Pearson | 482/94 |
| 5,215,410 | A * | 6/1993 | Karal | 405/205 |
| 5,215,510 | A * | 6/1993 | Baran | 482/104 |
| 5,669,859 | A * | 9/1997 | Liggett et al. | 482/94 |
| 6,926,649 | B2 * | 8/2005 | Slawinski | 482/104 |
| 7,374,516 | B2 * | 5/2008 | Lundquist | 482/104 |
| 7,815,555 | B2 * | 10/2010 | Webber et al. | 482/104 |
| 7,837,600 | B1 * | 11/2010 | Habing | 482/94 |
| 7,850,580 | B2 * | 12/2010 | Johnson et al. | 482/92 |

* cited by examiner

*Primary Examiner* — Stephen Crow
(74) *Attorney, Agent, or Firm* — Okuley Smith, LLC

(57) ABSTRACT

A weight lifting power cage for use by a weight lifter includes a floor frame assembly including a pair of side floor frames, a front lateral floor frame member, and a rear lateral floor member. A carriage is carried by the side floor frames and is movable simultaneously vertically and front to back. The carriage retains a weight bar mount for retaining a weight bar spanning between each side frame. The weight bar is movable by the carriage vertically and front to back. The movable carriage also carries a pair of vertical weight rack bars. An engagement mechanism enables the weight lifter to rack the weight bar from a weight lifting position without stepping forward or backward.

9 Claims, 5 Drawing Sheets

WEIGHT LIFTING POWER MACHINE WITH SLAVE RACK

CROSS-REFERENCE TO RELATED APPLICATIONS

None

STATEMENT REGARDING FEDERALLY SPONSORED RESEARCH

Not applicable.

BACKGROUND

The present invention generally relates to weight lifting cages for free weights and more particularly to a weight lifting cage having a movable carriage with slave racking capability.

Safety is always a concern to weight lifters, especially as the amount of weight approaches and passes the body weight of the weight lifter. Even lesser amounts of weight can be dangerous if the lifter loses control of the weight bar. For that reason, a spotter often is employed to assist the lifter should the amount of weight being lifted prove uncontrollable or should the lifter lose his/her balance while lifting weights. Often, however, a spotter is unavailable to the lifter and other safety means need to be employed.

One such other safety means is a weight lifting apparatus, often referred to as a power rack or power cage, such as is described in U.S. Pat. No. 5,215,510 or in U.S. Pat. No. 5,669,859. Such power cages are designed for the lifter to lift free weights without the need for a spotter. Power cages generally include a pair of side frames interconnected by a back frame. Each side frame carries a carriage, movable front to back and up and down. A weight bar runs laterally and is carried by the movable carriage. The lifter can add any desired amount of free weights to the weight bar and stand within the cage. The lifter can lift the bar while being able to step slightly forward and slightly backward within the cage, while simultaneously lifting the weight bar up and down. The dual-movable carriage permits such dual movement.

In one power cage model (see U.S. Pat. No. 5,669,859), each vertical side bar of the front and back frames have a series of outwardly projecting pins while the weight bar carriage has outwardly projecting hooks. The lifter can move to the front or to the back of the power cage and rack the weight bar by engaging the hooks onto the pins.

An improved power cage with slave rack is disclosed in commonly-assigned U.S. Pat. No. 7,374,516, which discloses a weight lifting power cage for use by a weight lifter and includes a frame assembly, a carriage, weight rack bars, and an engagement mechanism. The frame assembly includes a pair of side frames and a rear lateral frame interconnecting the pair of side frames. A carriage is carried by the side frames and is movable simultaneously vertically and front to back, i.e., depthenally. The carriage also carries a weight bar mount for retaining a weight bar spanning between each side frame. The weight bar is movable by the carriage vertically and depthenally, i.e., front to back. The movable carriage also carries a pair of vertical weight rack bars. An engagement mechanism enables the weight lifter to rack the weight bar from a weight lifting position without stepping forward or backward by dint of the rack bars also being mounted on the movable carriage.

The present invention is addressed to improving the weight lifting power cage of the '516 patent by eliminating much of the cage and the upper sliding mechanism to provide a simpler design with less parts (weight) and expense.

BRIEF SUMMARY

A weight lifting power cage for use by a weight lifter includes a floor frame assembly for placing on a floor and including a pair of parallelly spaced-apart side members each having a front end and a rear end; a pair of parallelly spaced-apart lateral members spanning between the side member front ends and the side member rear ends. Each frame assembly side member carries a lower slide bar and a pair of locking moving carriage assemblies. Each carriage assembly has a top end and is carried by the frame assembly side members. The carriage assemblies move front to rear during lifting by a weight lifter while the floor frame assembly remains stationary. The carriage assemblies have a pair of spaced-apart vertical slide bars which remain vertical as the carriage assembly moves front to rear; a weight bar spanning between each vertical slide bar; a pair of weight bar mount assemblies, each slidably mounted to vertical slide bar. The weight bar mount assemblies are affixed to the weight bar for vertical movement of the weight bar along the vertical slide bar. A pair of vertical weight rack bars is carried by the movable carriage and is located in spaced-apart adjacency from the weight bar and from the vertical slide bars. Alternatively, the vertical weight rack bars could carry a hook and slot mechanism for racking the weight bar. In both embodiments, an engagement mechanism is carried by the weight bar and is engagable with the weight rack bars. The engagement mechanism is activated by the weight lifter to rack the weight bar from a weight lifting position by the weight lifter rotating or flipping the wrists. A rigid overhead frame connector assembly spans between and connecting the carriage assemblies. The weight bar movable vertically and front to back, and said weight bar and weight rack bars movable together front to back.

Advantages of the present design include the elimination of upper guide rods with consequent less friction compared to the power cage of U.S. Pat. No. 7,374,516. Another advantage is that the disclosed machine uses less material, so there is less material for packing and shipping. Yet another advantage is a weight machine fitted with exterior shrouds or covers that is both stylistic and function in that they move with the safety spotter. Yet a further advantage is the elimination of lower guide rods as required in U.S. Publication No. 2009/0124469. These and other advantages will be readily apparent to those skilled in the art based on the disclosure set forth herein.

BRIEF DESCRIPTION

For a fuller understanding of the nature and advantages of the present invention, reference should be had to the following detailed description taken in connection with the accompanying drawings, in which.

The drawings will be described in further detail below.

DETAILED DESCRIPTION

Definitional terms appropriate for the present invention include:

"weight lifting power cage" or "power cage" means a frame assembly retaining a weight bar, upon which free weights can be secured, such as are disclosed in U.S. Pat. Nos. 5,215,510, 5,669,859, and 7,374,516.

"rack" means to place a weight bar, barbell, or other weight lifting assembly to a stationary or home position.

"vertical" means both upwardly and downwardly in a generally vertical direction.

"lateral" means side to side.

"depthenally" means front to back, back to front, or forwardly and rearwardly.

"weight bar" means a generally horizontal bar, often made of metal, upon which weights, often called "free weights", can be secured for a weight lifter or lifter to perform a series of repetitive movements of the weight bar as part of an exercise program or regimen, most often associated with body builders.

Initially, the drawings primarily show a purchaser or user of the disclosed weight lifting power cage would encounter the disclosed weight lifting power machine with aesthetic covers in place, such as illustrated in the accompanying drawings. Such covers do not interfere with the operation of the power cage and provide a degree of protection from some moving parts. Thus, such covers are for both aesthetic and safety purposes. Importantly, the covers or shrouds move along with the safety spotter. Of importance to the stability of the disclosed machine is the degree of rigidity built into the components that permits elimination of extra bars and guide rods required in the prior art.

Figure 1:
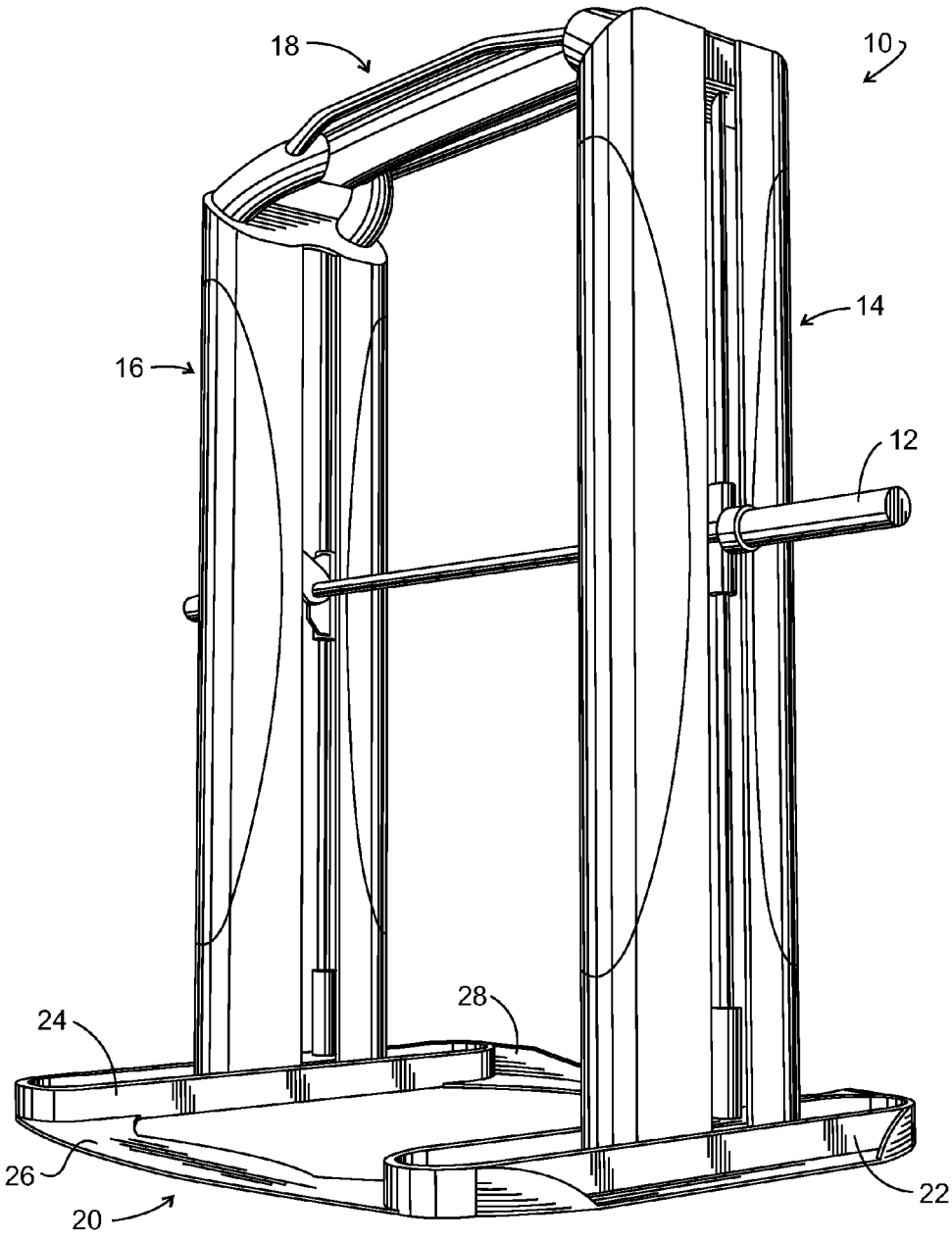
FIG. 1 is an isometric view of the weight lifting power cage.
Figure 2:
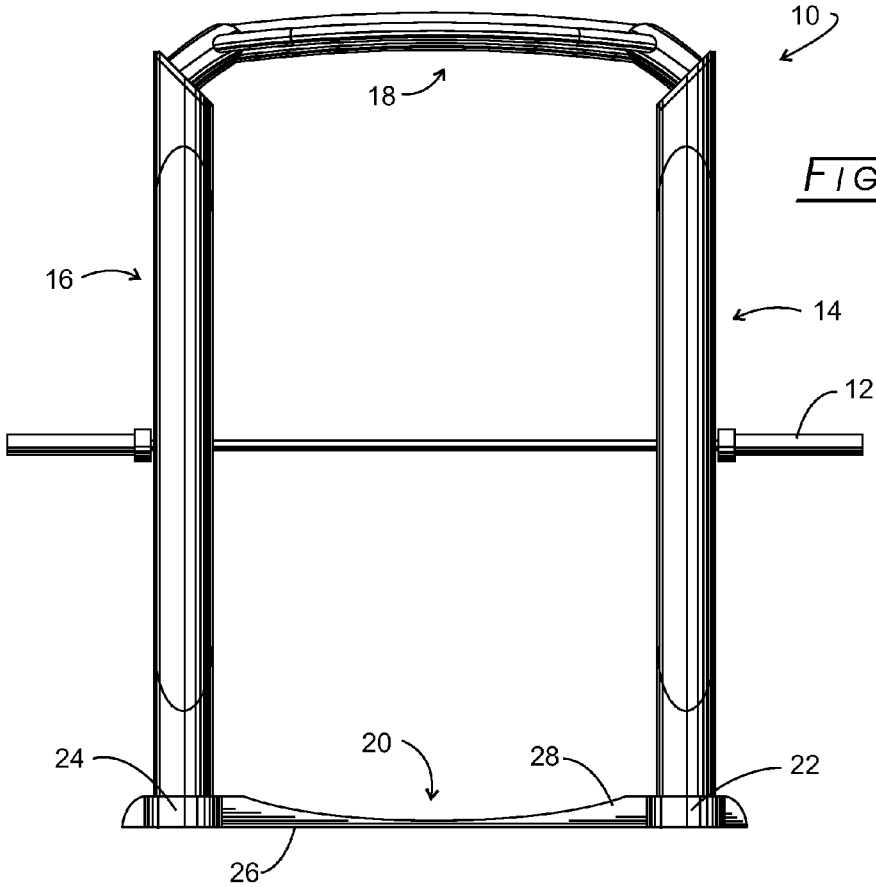
FIG. 2 is a front view of the weight lifting power cage of FIG. 1.
Figure 6:
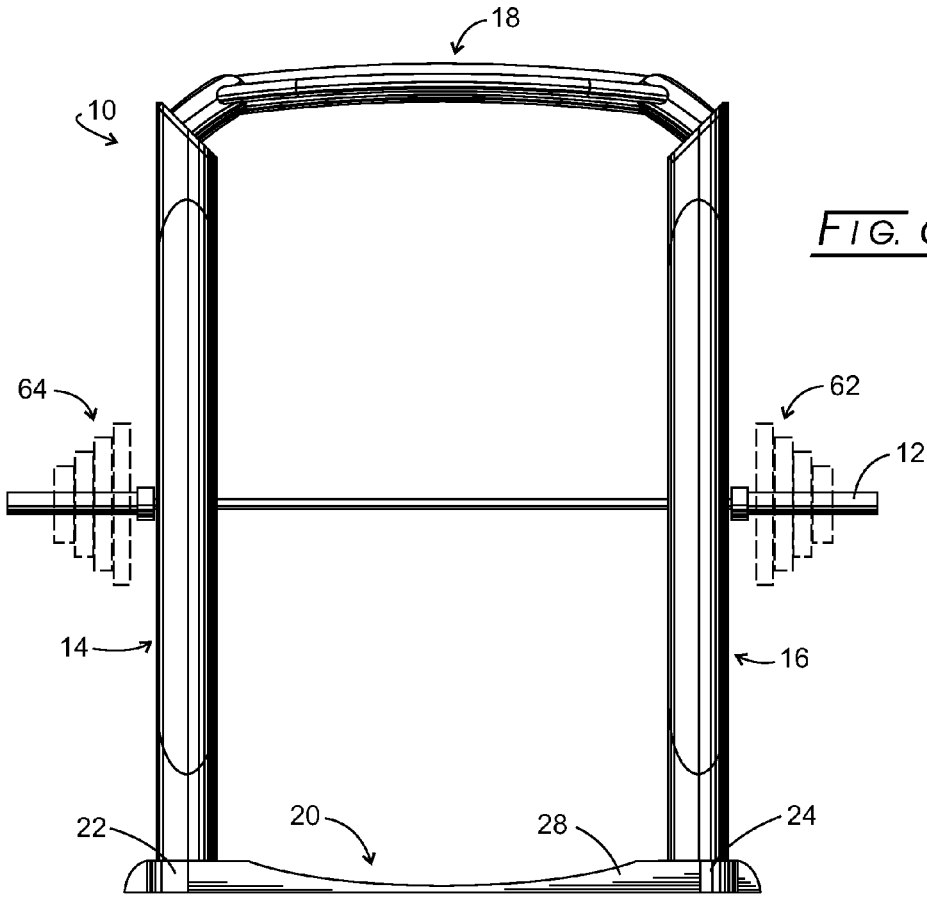
FIG. 6 is a rear view of the weight lifting power cage of FIG. 1 showing weight being carried by the weight bar.

Referring initially to FIGS. 1, 2 and 6, a weight lifting power cage, 10, is shown for retaining a weight bar, 12, which can carry free weights, 62 and 64, as illustrated in FIG. 6. Power cage 10 is formed from a pair of spaced-apart side carriage assemblies, 14 and 16. A rigid overhead frame connector assembly, 18, connects side carriage assemblies 14 and 16 by spanning between carriage assembly 14 and carriage assembly 16. A floor assembly, 20, carries side carriage assemblies 14 and 16. Floor assembly 20 is composed of a pair of parallelly spaced-apart side floor members, 22 and 24. The front ends of floor assembly side floor members 22 and 24 and connected by a lateral floor member, 26. A floor lateral member, 28, connects the rear ends of floor assembly side members 22 and 24.

While a rectilinear floor frame assembly has been illustrated and used for descriptional purposes, other floor frame assembly designs can be used in accordance with the disclosure set forth herein. For example, a flat plat or a triangular frame assembly can carry the side members. For present purposes, it only important that a floor frame assembly be provided to support the disclosed weight lifting machine and to carry the side members along which the carriage assemblies slide.

The respective frame members can be affixed together to form floor assembly 20 by a variety of techniques, such as, for example, bolts, welds, rivets, screws, or any similar joining technique. The same is true for the connection of rigid overhead frame connector 18 to carriage assemblies 14 and 16. The precise joining technique is unimportant, so long as requisite rigidity and strength are achieved for the intended weight lifting purposes of the inventive power cage. Also, such frame members often are formed from metal for strength and durability; although, other materials of construction are possible. Other than using nylon or other friction-reducing materials where appropriate, the entire power cage typically is constructed from metal, i.e., primarily constructed from metal.

Figure 3:
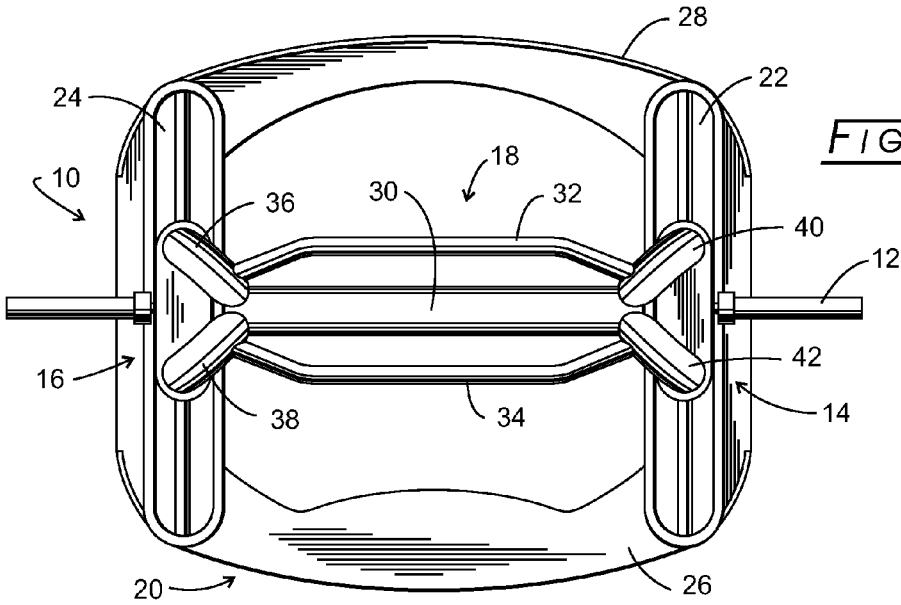
FIG. 3 is an overhead view of the weight lifting power cage of FIG. 1.
Figure 5:
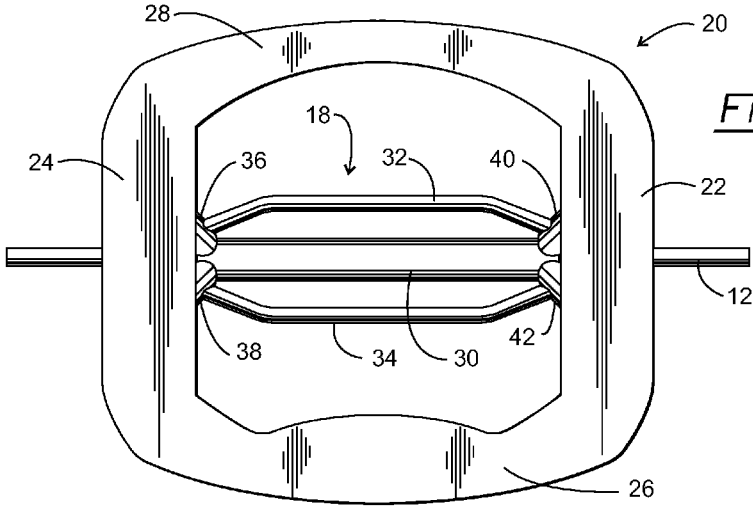
FIG. 5 is a bottom view of the weight lifting power cage of FIG. 1.

Referring now to FIGS. 3 and 5, rigid overhead frame connector 18 is seen to include a rigid central beam or bar, 30, which connects to floor assembly side members 22 and 24. A pair of rigid angle bars, 36 and 38, provide additional support for this overhead assembly with respect to carriage assembly 16; and a pair of rigid angle bars, 40 and 42, provide additional support for this overhead assembly with respect to carriage assembly 14. Overhead frame beam 30, then, is seen to be very rigid. Such extreme rigidity, along with the slidable connection of the carriage assemblies to floor frame 20 dispel with the need for a frame assembly, as required in U.S. Pat. No. 7,374,516, a Skilken-style assembly, Smith or other fixed cage mechanism, or other type of power cage design of the art. A pair of rigid chin-up bars, 32 and 34, connect to beam 30 and enable the user to perform exercises, such as, for example, chin-ups, leg lifts, and the like.

Figure 4:
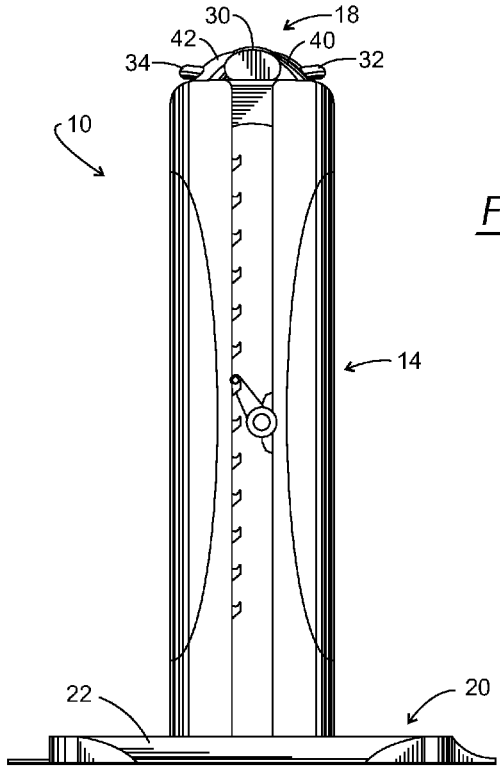
FIG. 4 is a side view of the weight lifting power cage of FIG. 1.
Figure 7:
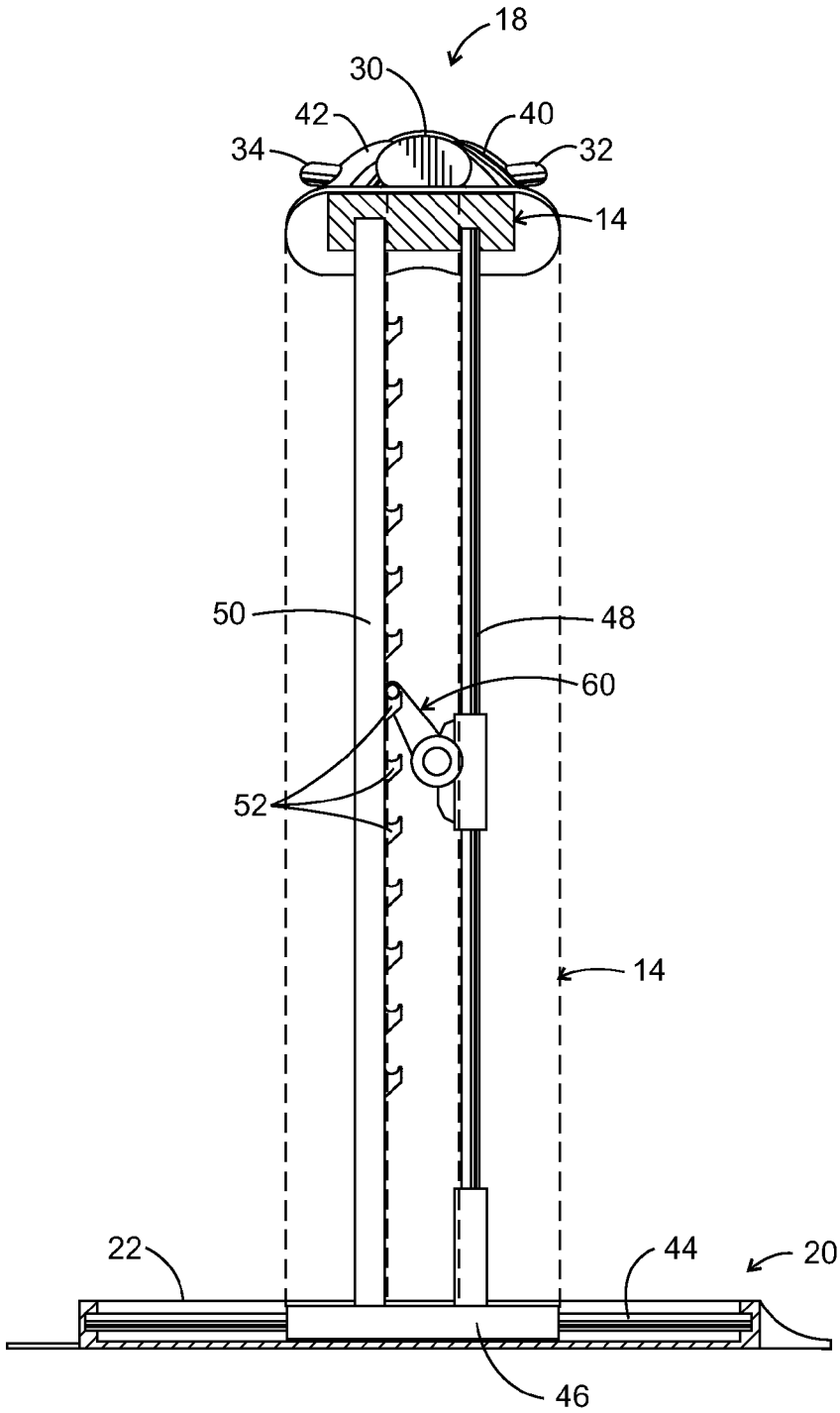
FIG. 7 is partial sectional view of the weight lifting power cage with covers shown in phantom.

Referring now to FIGS. 4 and 7, the details of the carriage assemblies is detailed. Construction nominally is the same as that disclosed in U.S. Pat. No. 7,374,516, so only a brief description will be given herein.

Carriage assemblies 14 and 16 weight bar 12 and enable a lifter to exercise using weight bar 12. Since each carriage assembly is the same, only carriage assembly 14 will be described. Running along the length (depthenal length) of floor assembly 22 is a lower slide bar, 44. A linear bearing assembly, 46, surrounds lower slide bar 44 and also is connected to a vertical slide bar, 48, and vertical rack bar, 50. Linear bearing assembly 46 and lower slide bar 44, along with rigid overhead frame connector 18 provide all of the necessary stability to power cage assembly 10, enabling a lifter to carry exercise with weight bar 12.

Linear bearing assembly 46 may include linear bearings, rollers, or similar mechanisms. Linear bearing assembly 46 carries a stop pin (not shown) which can be engaged to prevent linear bearing assembly 46 from moving along the extent of slide bar 44, whereby the inventive power cage becomes a traditional "Smith" or fixed power cage mechanism. Alternatively, linear bearing assembly could be replaced with a guide sleeve or similar mechanism, as those skilled the art will appreciate.

Vertical rack bar 50 bears a series of projecting rack pins, such as, for example, pin 52. Now, weight bar 12 carries a latch assembly, 60, which is rotatable about weight bar 12 and matable with rack pin 52, as well as the other rack pins carried by vertical rack bar 50. Latch assembly 60 is shown as a U-shaped assembly; although, a variety of shapes are operable. The same is true of the rack pins, which can be formed in a variety of shapes.

Latch assembly 60 is only one suitable engagement mechanism for racking weight bar 12. Other suitable engagement mechanisms are known in the art. For example, a slot and hook arrangement could be used to rack weight bar 12. The skilled artisan can envision additional engagement mechanisms based on the disclosure set forth herein.

So long as latch assembly used can catch the weight bar, the desired racking purpose is achieved. That is, should the lifter desire to cease lifting weight bar 12, the lifter need only move weight bar 12 slightly to the rear of the lifter and engage the rack pins with the latch assemblies to rack weight bar 12. The lifter can accomplish racking simply by rotating the hands forwards or backwards depending upon orientation of the lifter, either under normal or emergency (imminent loss of control of weight bar 12) conditions, to rack weight bar 12.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. A weight lifting machine for use by a weight lifter, which comprises:

(a) a floor frame assembly for placing on a floor and carrying a pair of generally parallel, spaced-apart lower slide bars;

(b) a pair of locking moving carriage assemblies, each carriage assembly having a top end and being carried only by said frame assembly lower slide bars, said carriage assemblies being movable front to rear only by said frame assembly lower slide bars during lifting by a weight lifter while said floor frame assembly remains stationary, said carriage assemblies comprising:

(i) a pair of spaced-apart vertical slide bars which remain vertical as the carriage assembly moves front to rear, (ii) a weight bar spanning between each vertical slide bar, (iii) a pair of weight bar mount assemblies, each slidably mounted to said frame assembly lower side bars, said weight bar mount assemblies affixed to said weight bar for vertical movement of said weight bar along said carriage assembly slide members, (iv) a pair of vertical weight rack bars carried by said movable carriage and located in spaced-apart adjacency from said weight bar and from said vertical slide bars, (v) an engagement mechanism carried by said weight bar and engagable with said weight rack bar by a weight lifter, and (vi) a rigid overhead frame connector assembly spanning between and connecting said carriage assemblies;

said weight bar movable vertically and front to back, and said weight bar and weight rack bars movable together front to back.

2. The weight lifting machine of claim 1, wherein said pair of vertical weight rack bars carries outward projecting pins and said weight bar carries a latch assembly matable with said pins for racking said weight bar.

3. The weight lifting machine of claim 1, wherein each carriage assembly has a lower guide sleeve that surmounts said floor frame lower slide bar for moving each carriage frame assembly along the extent of said floor frame lower slide bar.

4. The weight lifting machine of claim 3, wherein each lower guide sleeve also carries stop pins selectively engagable to prevent movement of said carriage assemblies.

5. The weight lifting machine of claim 1, wherein said weight bar retains a pair of latch assemblies engagable with said vertical weight rack bars to restrict the vertical movement of said weight bar.

6. The weight lifting machine of claim 1, wherein said weight bar retains weights about both ends thereof.

7. The weight lifting machine of claim 1, which is fabricated primarily of metal.

8. The weight lifting machine of claim 1, wherein said carriage assemblies and said floor frame assembly slide members are covered with shrouds.

9. The weight lifting machine of claim 1, wherein said floor frame comprises a pair of parallelly spaced-apart side members each having a front end and a rear end; a pair of parallelly spaced-apart lateral members spanning between said side member front ends and said side member rear ends, each frame assembly side member carrying said lower slide bar.

* * * * *